US005536053A

United States Patent [19]

Quattlebaum

[11] Patent Number: 5,536,053

[45] Date of Patent: Jul. 16, 1996

[54] DEVICE FOR BENDING AND SECURING TREE LIMBS OUT OF NORMAL GROWING DISPOSITION

[76] Inventor: Nathan R. Quattlebaum, 313 Nathan Miller Rd., Gilbert, S.C. 29054

[21] Appl. No.: 255,440

[22] Filed: Jun. 8, 1994

[51] Int. Cl.[6] ..... B66C 1/26

[52] U.S. Cl. ..... 294/1.1; 294/82.11

[58] Field of Search ..... 294/1.1, 19.1, 294/19.2, 66.1, 81.56, 82.1–82.13, 82.24, 82.27, 82.31, 85, 111, 112; 24/698.1; 47/1.01, 42; 242/129, 588, 588.2

[56] References Cited

U.S. PATENT DOCUMENTS

| | | | |
|---|---|---|---|
| 76,248 | 3/1868 | Richardson | 294/19.1 X |
| 951,463 | 3/1910 | Spears | 294/82.1 |
| 1,050,479 | 1/1913 | Long | 294/82.1 |
| 1,160,016 | 11/1915 | Utsman | 294/82.1 |
| 1,621,030 | 3/1927 | Salisbury | 294/82.1 |
| 1,623,497 | 4/1927 | Rurup . | |
| 1,858,941 | 5/1932 | Salmon | 294/66.1 |
| 2,531,422 | 11/1950 | Gerum . | |
| 2,542,665 | 2/1951 | Gustafson . | |
| 2,651,539 | 9/1953 | Poisal . | |
| 4,120,189 | 10/1978 | Jones | 294/82.1 X |
| 4,171,842 | 10/1979 | Tolle | 294/82.1 |
| 4,438,620 | 3/1984 | Beardsley . | |
| 4,785,509 | 11/1988 | Fisher | 294/82.1 |
| 5,415,450 | 5/1995 | Faxon | 294/82.31 |

FOREIGN PATENT DOCUMENTS

| | | | |
|---|---|---|---|
| 198998 | 8/1990 | Japan | 294/82.31 |

*Primary Examiner*—Johnny D. Cherry
*Attorney, Agent, or Firm*—Michael A. Mann

[57] ABSTRACT

A device is disclosed for use by hunters to bend and secure tree limbs out of normal growing disposition from an elevated hunting position in a tree. The device comprises a grasping element having a hook-shaped portion for engagement about a tree limb, a first flexible cord attached to the grasping element at a spacing from the hook portion for throwing the grasping element over a tree limb and pulling the element into hooked engagement with the tree limb, and a second flexible cord attached to the grasping element adjacent the hook portion for use in disengaging the grasping element from a tree limb.

21 Claims, 2 Drawing Sheets

DEVICE FOR BENDING AND SECURING TREE LIMBS OUT OF NORMAL GROWING DISPOSITION

BACKGROUND OF THE INVENTION

The present invention relates generally to devices for use by hunters and, more particularly, to a novel device adapted to be used by hunters while elevated in a tree, e.g., while using a tree stand, for bending and securing tree limbs out of normal growing disposition so as to provide hunters with a clear view of the area beneath the hunter.

It is a common practice for hunters in wooded areas to utilize a climbing device such as a tree stand to scale a tree to an elevated position at which the hunter my be seated while awaiting wild game to approach. While this hunting technique offers certain advantages, a disadvantage is that tree limbs tend to obscure a hunter's line of sight, which car inhibit a hunter's ability to see as well as to shoot wild game. A not uncommon practice is for hunters to simply cut or break limbs to improve the field of vision from a tree stand, but this practice is illegal when hunting on government-owned property, is discouraged in any event from an environmental standpoint, and also can pose a significant risk of accident and injury to the hunter in reaching for and cutting or breaking adjacent limbs.

SUMMARY OF THE INVENTION

It is accordingly an object of the present invention to provide a device which hunters, as well as other, can utilize for bending and securing tree limbs out of normal growing disposition without actually breaking or cutting the limbs, so that the limbs can be returned undamaged to a normal growing position at a later point in time after a hunter has completed a hunting excursion.

Briefly summarized, the device of the present invention basically comprises a grasping element having a hook-shaped portion for engagement about a tree limb, a first flexible cord attached to the grasping element at a spacing from the hook portion for use in throwing the grasping element over a tree limb and pulling the grasping element into engagement of its hook portion with the tree limb, and a second flexible cord attached to the grasping element adjacent the hook portion for use in disengaging the grasping element from a tree limb.

In the preferred embodiment, the grasping element includes a shank portion from one end of which the hook portion extends to partially enclose a limb-receiving area. The first cord is attached to the opposite end of the shank portion and the second cord is attached to the hook portion at the side thereof opposite the limb-receiving area. The shank portion is of a cross-sectional shape having a generally flat surface facing the limb-receiving area and tapering narrowingly away from the limb-receiving area to guide sliding movement over a limb into engagement of the limb in the limb-receiving area. A plurality of limb-gripping teeth are provided within the limb-receiving area of the hook portion to enhance the ability of the hook portion to grasp a tree limb.

DETAILED DESCRIPTION OF THE PREFERRED EMBODIMENT

Figure 1:
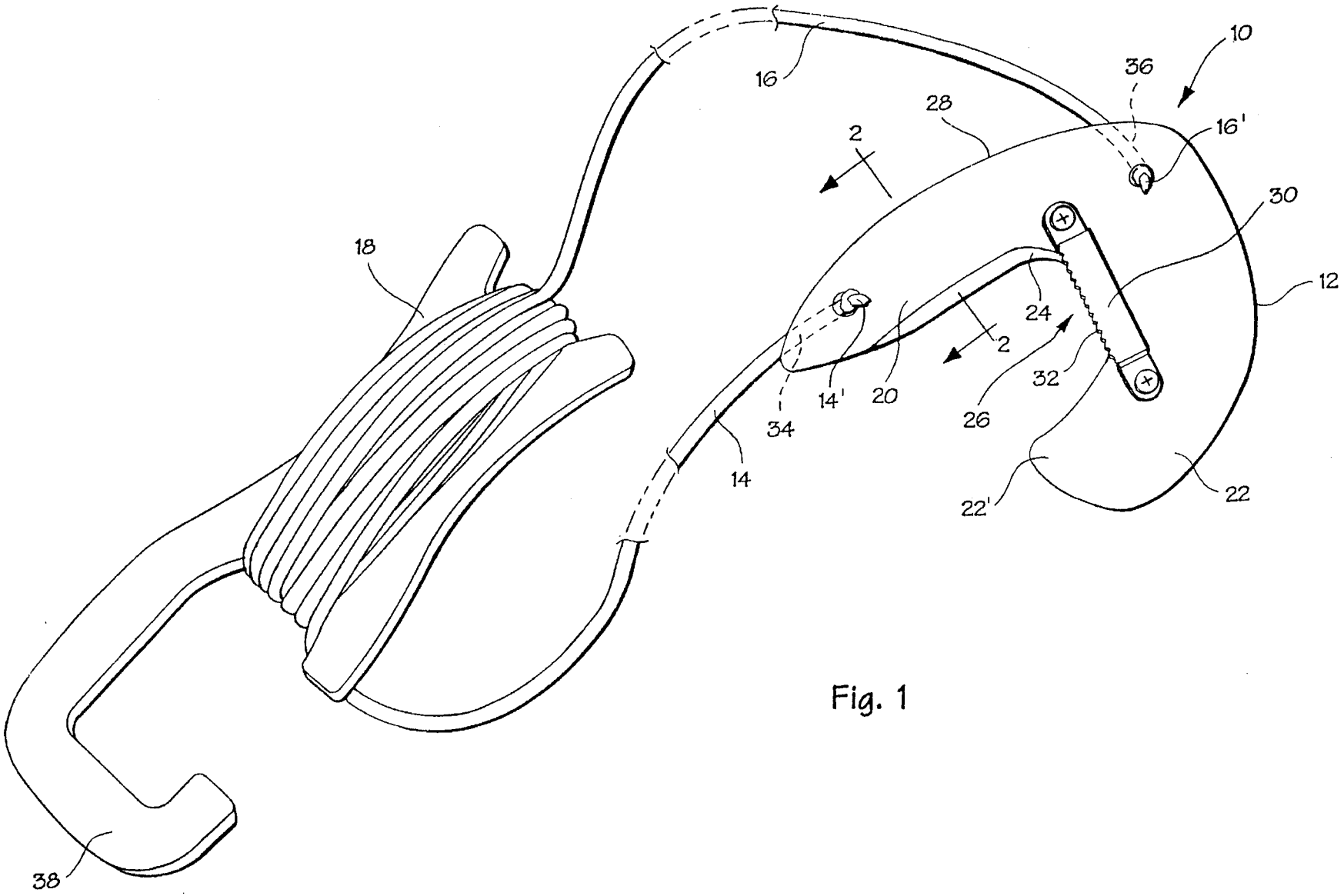
FIG. 1 is a perspective view of the device of the present invention.

Referring now to the accompanying drawings and initially to FIG. 1, a tree limb bending and securing device according to the present invention is shown generally at 10 and basically includes a grasping element 12 having manipulating cords 14,16 attached at spaced locations for use in engaging and disengaging the grasping element 12 to and from a tree limb, as more fully described hereinafter. The grasping cords 14,16 extend to and are wrapped about a storage implement 18.

Figure 2:
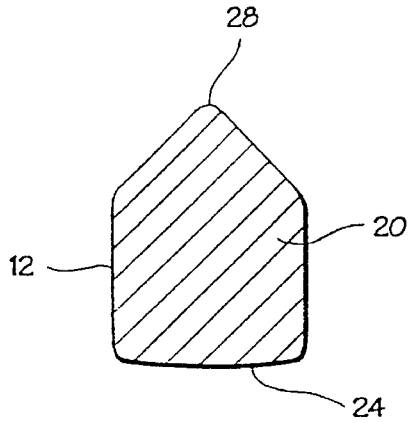
FIG. 2 is a vertical cross-sectional view through the device of FIG. 1, taken along line 2—2 thereof.

The grasping element 12 basically has a shank portion 20 merging with a generally curved hook-shaped portion 22 terminating at a free end 22'. The grasping element 12 is preferably fabricated as a unitary body of material, e.g., an integrally molded plastic body. In cross-section, the shank portion 20 of the grasping element 12 has a generally flat, slightly rounded inner surface 24 facing the limb-receiving area 26 defined within the hook-shaped portion 22, and tapers narrowingly outwardly away from the limb-receiving area 26 at both opposite sides of the grasping element 12 convergingly to a ridge 28 extending lengthwise along the shank portion 20 to the hook-shaped portion 22, as best seen in FIG. 2. A pair of toothed bars 30 are affixed to the opposite side faces of the hook-shaped portion 22 laterally across the limb-receiving area 26 with the teeth 32 of the bars 30 facing inwardly of the limb-receiving area 26.

A bore 34 is formed through the terminal end of the shank 20 opposite the hook-shaped portion 22 and opens laterally to one side of the shank portion 20. One end of the cord 14 is threaded through the bore 34 and secured therein by forming a knot 14' to prevent the cord 14 from being pulled through the bore 34. Another bore 36 is formed laterally through the hook-shaped portion 22 of the grasping element 12 adjacent the ridge 28 at the side of the grasping element 12 outwardly away from the limb-receiving area 26. One end of the cord 16 extends through the bore 36 and is secured therein against unintended removal by a knot 16'. The opposite ends of the cords 14,16 are secured to the storage implement 18, which is also equipped with a hook-shaped portion 38 to enable the storage implement 18 to be easily hung on a tree stand, a limb, a user's belt, etc.

Figure 3:
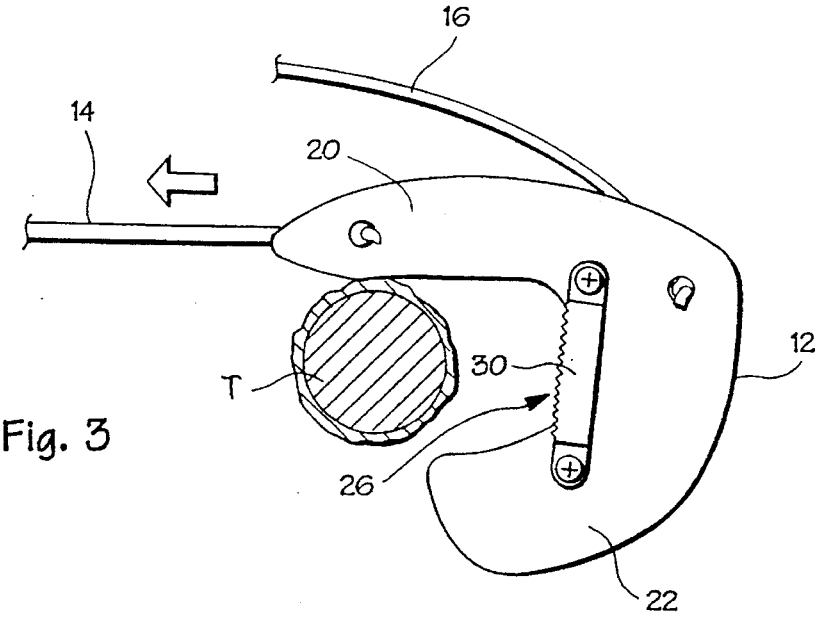
FIG. 3 is a side view of the device of FIG. 1, illustrating the engagement thereof with a tree limb.

Use of the device 10 may thus be understood. When a hunter has ascended a tree, e.g., utilizing a tree stand, to a resting position at which the hunter will await wild game, a tree limb obscuring the hunter's field of vision may be pulled out of the hunter's line of sight by paying out a sufficient length of the cords 14,16 from the storage implement 18 to enable the grasping element to be thrown over the limb while the hunter retains hold of the storage implement 18. With the grasping element 12 hanging by the cords 14,16 over the limb, the cord 14 is utilized to pull the grasping element 12 into engagement with the tree limb. In particular, as depicted in FIG. 3, because the cord 14 is connected to the end of the shank portion 20, the hook-shaped portion 22 of the grasping element 12 tends to engage about and receive the tree limb T within the area 26 until the teeth 32 of the bars 30 are in gripping frictional contact with the tree limb.

Often, the grasping element 12 will be oriented such that the generally flat inner surface 24 of the shank portion 20 slides over the tree limb to guide the grasping element into such limb-gripping engagement. However, in case the opposite ridged side of the gripping element 12 begins to slide over the tree limb, the tapered configuration of the outward surface of the shank portion 20 tends to cause the grasping element 12 to twist to orient the hook-shaped portion 22 for receipt of the limb in the area 26 upon sliding contact of the tapered ridged surface with the limb T.

Figure 4:
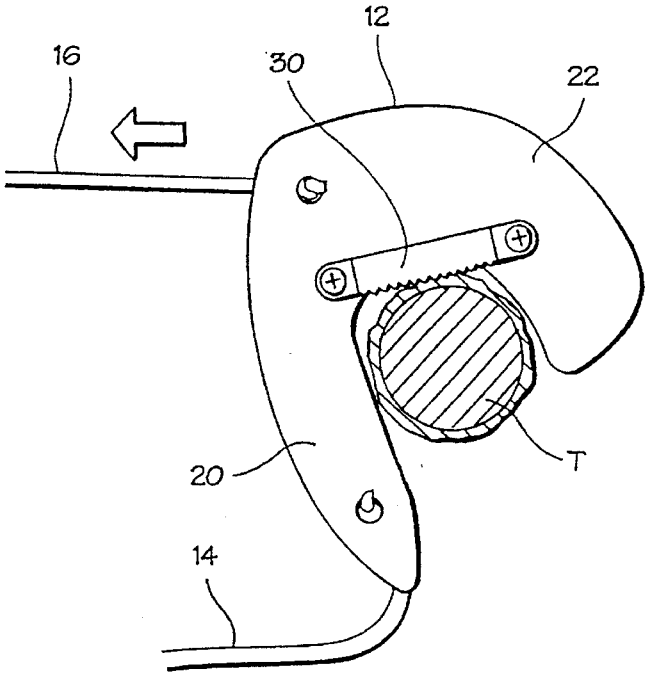
FIG. 4 is a side elevational view similar to FIG. 3, illustrating the removal of the device of the present invention from the tree limb.

Upon secure engagement of the limb within the receiving area 26, the cord 14 is pulled further by the hunter to bend the tree limb in any appropriate direction until the limb is sufficiently out of the hunter's field of vision, whereupon the cord 14 is secured, e.g., by tying to the hunter's tree stand or to another limb or the tree trunk, or by wrapping the excess length of the cords 14,16 about the storage implement 18 and securing its hook portion 38 to the tree stand or another limb, thus holding the limb in its bent disposition. When it is desired to remove the grasping element 12 from the tree limb, the cords 14,16 are slackened and the hunter then pulls on the cord 16 which serves to rotate the hook-shaped portion 22 about the tree limb until the grasping element 12 disengages gravitationally from the tree limb, as depicted in FIG. 4, whereupon the hunter reels in the cords 14,16 and winds them about the storage implement 18.

It will thus be understood that the present device easily enables a hunter to safely grasp and bend tree limbs and secure them in bent disposition from the safety of a seated position on a tree stand. Cutting or breaking of limbs, as has been the practice in the past, is no longer necessary. Thus, upon removal of the device from a bent tree limb, the limb is allowed to reassume its natural growing disposition unharmed.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for bending tree limbs out of normal growing disposition, said device comprising:

a grasping element having a hook-shaped portion and a shank, said hook-shaped portion having a limb receiving area with a rounded inner surface for receiving said limb, said shank having a first end;

means formed at said first end of said shank of said grasping element for attaching a first cord;

means carried by said grasping element at said rounded inner surface for gripping said limb so that said grasping element does not slip laterally off said limb; and means formed in said hook-shaped portion forward of said gripping means for securing a second cord to said device so that, when said first cord is attached to said shank and is being pulled, said grasping element is bending said limb, and said gripping means is gripping said limb, pulling said second cord parallel to said first cord will cause said grasping element to rotate out of engagement with said limb.

2. The device as recited in claim 1, wherein said gripping means includes a plurality of teeth.

3. The device as recited in claim 1, wherein said gripping means is at least one toothed bar.

4. The device as recited in claim 1, wherein said gripping means is two toothed bars.

5. The device as recited in claim 1, wherein said gripping means is a pair of toothed bars disposed laterally of said rounded inner surface.

6. The device as recited in claim 1, wherein said end of said shank is tapered.

7. A device for bending tree limbs out of normal growing disposition, said device comprising:

a grasping element having a hook-shaped portion and a shank, said hook-shaped portion having a limb receiving area with a rounded inner surface for receiving said limb, said shank having a first end;

a first cord attached to said first end of said shank;

means carried by said grasping element at said rounded inner surface for gripping said limb so that said grasping element does not slip laterally off said limb;

a second cord; and means formed in said hook-shaped portion forward of said gripping means for securing said second cord to said grasping element so that, when said first cord is attached to said shank and is being pulled, said grasping element is bending said limb, and said gripping means is gripping said limb, pulling said second cord parallel to said first cord will cause said grasping element to rotate out of engagement with said limb.

8. The device as recited in claim 7, wherein said gripping means includes a plurality of teeth.

9. The device as recited in claim 7, wherein said gripping means is at least one toothed bar.

10. The device as recited in claim 7, wherein said gripping means is two toothed bars.

11. The device as recited in claim 7, wherein said gripping means is a pair of toothed bars disposed laterally of said rounded inner surface.

12. The device as recited in claim 7, wherein said end of said shank is tapered.

13. The device as recited in claim 7, wherein said securing means is a bore formed in said hook-shaped portion and dimensioned to receive said second cord.

14. A device for bending tree limbs out of normal growing disposition by a user in a hunting stand, said device comprising:

a grasping element having a hook-shaped portion and a shank, said hook-shaped portion having a limb receiving area with a rounded inner surface for receiving said limb, said shank having a first end;

a storage implement;

a first cord having a first end and a second end, said first end attached to said first end of said shank and said second end attached to said storage implement;

means carried by said grasping element at said rounded inner surface for gripping said limb so that said grasping element does not slip laterally off said limb;

a second cord having a first end and a second end, said second end attached to said storage implement; and means formed in said hook-shaped portion forward of said gripping means for securing said first end of said second cord to said grasping element so that, when said first cord is attached to said shank and is being pulled, said grasping element is bending said limb, and said gripping means is gripping said limb, pulling said second cord parallel to said first cord will cause said grasping element to rotate out of engagement with said limb.

15. The device as recited in claim 14, wherein said storage implement is formed to hang from a tree stand.

16. The device as recited in claim 14, wherein said gripping means includes a plurality of teeth.

17. The device as recited in claim 14, wherein said gripping means is at least one toothed bar.

18. The device as recited in claim 14, wherein said gripping means is two toothed bars.

19. The device as recited in claim 14, wherein said gripping means is a pair of toothed bars disposed laterally of said rounded inner surface.

20. The device as recited in claim 14, wherein said end of said shank is tapered.

21. The device as recited in claim 14, wherein said securing means is a bore formed in said hook-shaped portion and dimensioned to receive said second cord.

* * * * *